US007528551B2

(12) United States Patent
Ball

(10) Patent No.: US 7,528,551 B2
(45) Date of Patent: May 5, 2009

(54) LED CONTROL SYSTEM

(75) Inventor: Alan R. Ball, Gilbert, AZ (US)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 75 days.

(21) Appl. No.: 11/678,793

(22) Filed: Feb. 26, 2007

(65) Prior Publication Data

US 2008/0203932 A1 Aug. 28, 2008

(51) Int. Cl.
*H05B 41/16* (2006.01)

(52) U.S. Cl. ..... 315/247; 315/246; 315/291; 315/312; 315/185 S

(58) Field of Classification Search ..... 315/247, 315/246, 185 S, 200 A, 224, 225, 149–159, 315/209 R, 291, 307–311, 312–326, 274–289
See application file for complete search history.

(56) References Cited

U.S. PATENT DOCUMENTS

| | | | | |
|---|---|---|---|---|
| 6,285,139 | B1 | 9/2001 | Ghanem | |
| 6,385,060 | B1 | 5/2002 | Basso et al. | |
| 6,970,364 | B2 | 11/2005 | Batarseh et al. | |
| 6,987,676 | B2 | 1/2006 | Cheng et al. | |
| 6,989,807 | B2 | 1/2006 | Chiang | |
| 7,015,682 | B2 | 3/2006 | Santin et al. | |
| 7,135,825 | B2 * | 11/2006 | Tanabe | 315/308 |
| 2008/0129220 | A1 * | 6/2008 | Shteynberg et al. | 315/291 |

OTHER PUBLICATIONS

Data Sheet, "TLV431A, TLV431B Low Voltage Precision Adjustable Shunt Regulator", Copyright 2006, Semiconductor Components Industries, LLC, Feb. 2006-Rev.9, 14 pages.

* cited by examiner

*Primary Examiner*—Tuyet Vo
(74) *Attorney, Agent, or Firm*—Robert F. Hightower

(57) ABSTRACT

In one embodiment, an LED system is controlled to have a substantially unity power factor.

15 Claims, 5 Drawing Sheets

10

LED CONTROL SYSTEM

BACKGROUND OF THE INVENTION

The present invention relates, in general, to electronics, and more particularly, to methods of forming semiconductor devices and structure.

In the past, the electronics industry utilized light emitting diodes (LEDs) for a variety of applications. Improvements in the quality and efficiency of light emitting diodes (LEDs) facilitated the use of LEDs in automotive lighting applications such as for brake lights and taillights. Further advances in LEDs facilitated the use for more traditional AC lighting applications such as traffic lights, fluorescent lights, street lights and other lighting application. Typical control systems for LED applications converted an AC waveform into a DC voltage and used this DC voltage to power the LEDs. Systems to control LED are disclosed in U.S. Pat. No. 6,285,139 issued to Mohamed Ghanem on Sep. 4, 2001 and U.S. Pat. No. 6,989,807 issued to Johnson Chiang on Jan. 24, 2006. Most such LED control systems had a high cost. It is desirable to configure the each LEDs system to control the power factor in order to reduce operating costs. It is also desirable to keep the costs very low.

Accordingly, it is desirable to have an LED control system is simple to design, that has a low cost, and that controls the power factor to a substantially unity value.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action.

DETAILED DESCRIPTION OF THE DRAWINGS

Figure 1:
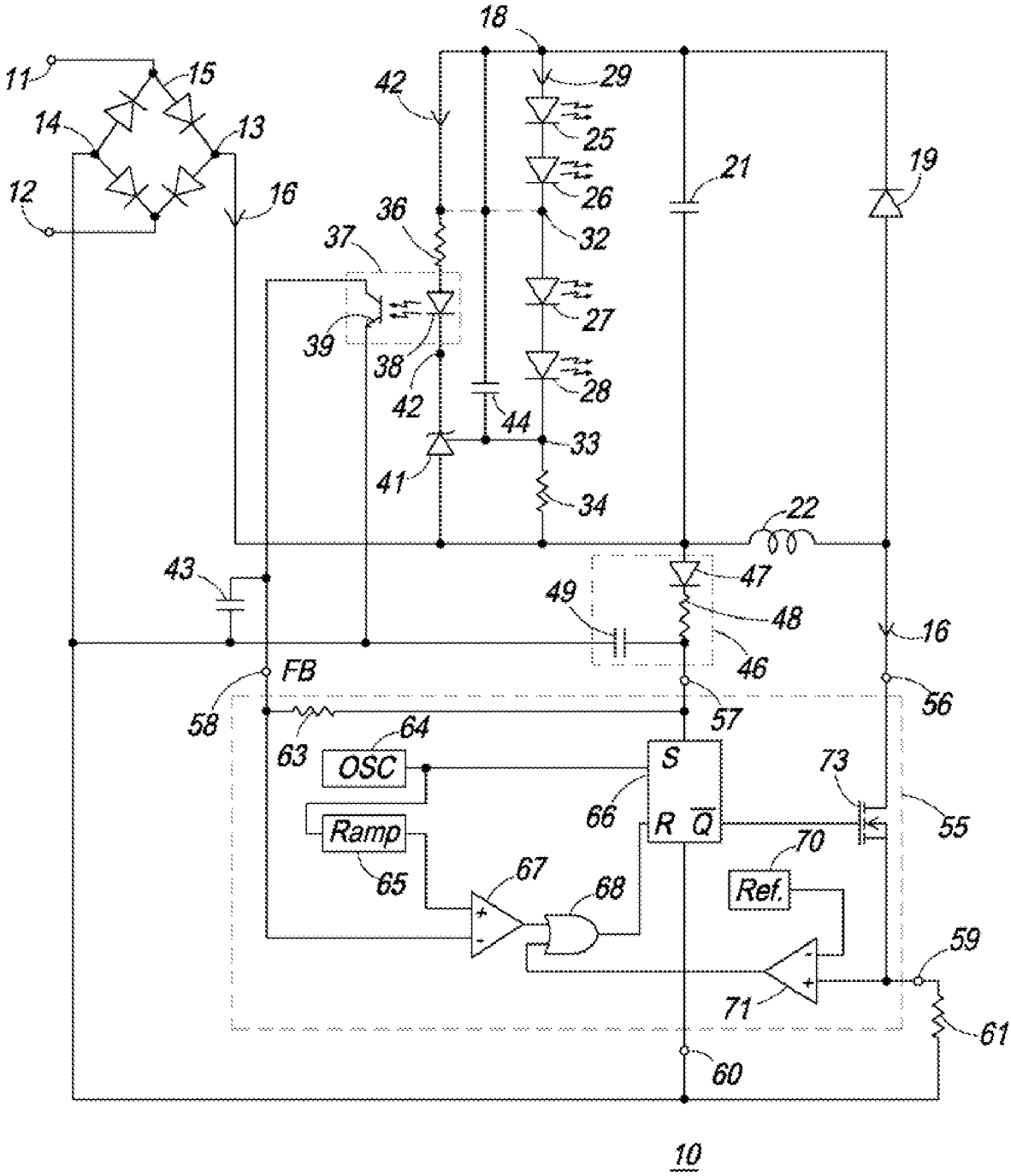
FIG. 1 schematically illustrates an embodiment of a portion of an LED system in accordance with the present invention.

FIG. 1 schematically illustrates a preferred embodiment of a portion of an LED system 10 that operates a plurality of LEDs with a substantially unity power factor. System 10 includes a plurality of LEDs 20-28 that are connected in a series configuration and through which and an LED current 29 flows. A switching power supply controller of system 10, such as a pulse width modulated (PWM) controller 55, controls current 29 to a substantially constant value. As will be seen further hereinafter, LEDs 25-28 receive an input voltage that is referenced to a first common voltage and PWM controller 55 is reference to a second common voltage that is different from the first common voltage. Additionally, an error amplifier is coupled to LEDs 25-28 to form a sense signal that is representative of the value of current 29. The error amplifier is reference to the first common voltage.

System 10 also includes a bridge rectifier 15, the error amplifier such as a shunt regulator 41, an optical coupler 37, an inductor 22, a rectifier such as a diode 19, an energy storage capacitor 21, and a power converter 46. Power converter 46 is utilized to form operating power for controller 55. Converter 46 includes a diode 47, a resistor 48, and a capacitor 49 that convert the time varying voltage from rectifier 15 to a substantially dc voltage for operating controller 55.

PWM controller 55 usually includes an oscillator 64 that forms a substantially constant frequency clock signal, a ramp generator or ramp 65 that forms a ramp signal responsively to receiving a clock signal from oscillator 64, a PWM comparator 67, an OR gate 68, a PWM latch 66, a power switch such as a power transistor 73, a current limit comparator 71, and a reference generator or reference 70. PWM controller 55 receives power between a voltage input 57 and a voltage return 60. Input 57 is coupled to receive power from the first common voltage on terminal 13 through power converter 46, and return 60 is coupled to a second common voltage on a terminal 14 of bridge rectifier 15. Oscillator 64, ramp 65, latch 66, comparator 67, gate 68, reference 70, and comparator 71 are connected to receive power between input 57 and return 60. Controller 55 also includes a feedback (FB) input 58 that receives a FB signal that is representative of the value of current 29, an output 56 that is coupled to control the value of current 29, and a current limit input 59 that receives a signal that is representative the value of the current through transistor 73. A pull-up resistor 63 is connected between input 58 and input 57 to provide a pull-up voltage for the output of coupler 37. A resistor 36 is used to select the desired value of current through regulator 41. Although resistor 36 s illustrated as being connected to receive power from input 18, resistor 36 may be connected to other points to receive power such as at a node 32 as illustrated in dashed lines. Connecting resistor 36 to node 32 reduces power dissipation.

Rectifier 15 receives and AC input voltage, such as the AC signal of a bulk input voltage from a household mains, between terminals 11 and 12, and forms a rectified AC signal between terminals 13 and 14. This rectified AC signal is a time varying signal. Thus, the dc voltage received by LEDs 25-28 between input 18 and terminal 13 is referenced to the time varying signal on terminal 13, thus, the dc voltage rides on top of this time varying voltage.

A frequency compensation capacitor 43 usually is connected between input 58 and the common reference voltage of terminal 14, and another frequency compensation capacitor 44 may be coupled between the sense input of regulator 41 and the terminal that applies the voltage for operating regulator 41. Capacitors 43 and 44 provide loop frequency compensation for the control loop of system 10. The value of capacitors 43 and 44 generally are selected to provide a bandwidth of approximately ten (10) Hz for systems that have a sixty (60) cycle AC signal between terminals 11 and 12 and a bandwidth of approximately eight (8) Hz for systems that have a fifty (50) cycle AC signal.

In operation, as current 29 flows through LEDs 25-28 and resistor 34, resistor 34 forms a voltage that is representative of the value of current 29. The voltage across resistor 34 causes a current 42 to flow through shunt regulator 41 which is also representative of the value of current 29. Current 42 also flows through a resistor 36 and an LED 38 of optical coupler 37. If the value of current 29 increases, the value of current 42 would also increase which would causes a transistor 39 of coupler 37 to conduct more current. An increased current through transistor 39 would decrease the feedback (FB) signal on input 58 of controller 55. A decrease in the FB signal would result in a decrease in the portion of a cycle of oscillator 64 that transistor 73 would be enabled, thus, a decrease in the duty cycle of transistor 73 of controller 55. Since oscillator 64 has a substantially fixed frequency, controller 55 switches transistor 73 at a fixed frequency with a fixed period. During the portion of a period that transistor 73 is enabled, an input current 16 flows from terminal 13 through inductor 22, transistor 73, input 59, and resistor 61 to terminal 14. In the portion of the period that transistor 73 is disabled, the energy stored in inductor 22 is transferred through diode 19 to charge capacitor 21 and maintain the LED voltage between LED input 18 and terminal 13. It will be appreciated by those skilled in the art that although the LED voltage between input 18 and terminal 13 is controlled to be a substantially constant DC voltage, the LED voltage is referenced to the voltage on terminal 13. Because the voltage on terminal 13 is a rectified AC voltage, the LED voltage appears as a DC voltage that is imposed upon the time varying reference voltage that is on terminal 13. The time varying reference voltage varies a rate of the rectified value of the voltage between terminals 11 and 12 (Typically either one hundred Hertz (100 Hz) or one hundred and twenty Hertz (120 Hz)).

As current 16 flows through resistor 61, it forms a sense signal that is representative of the value of current 16. Comparator 71 receives the sense signal. If the value of current 16 becomes excessive, the value of the sense signal increases to a value that forces the output of comparator high. The high from comparator 71 forces the output of gate 68 high which resets latch 66 and disables transistor 73. This provides an over-current protection that prevents transistor 73 from conducting currents that could damage transistor 73 or LEDs 25-28. Such over-current values of current 16 generally would occur if there is a short or other problem condition within system 10.

Figure 2:
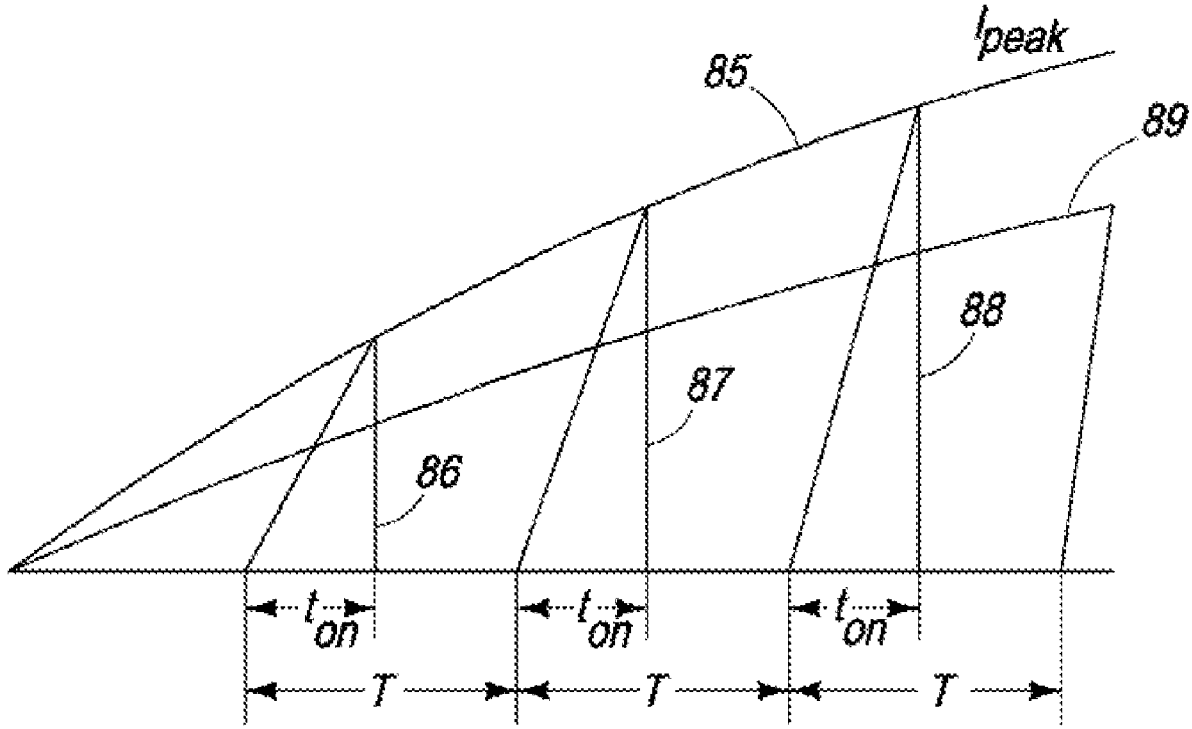
FIG. 2 is a graph having plots that illustrate some of the signals of the system of FIG. 1 in accordance with the present invention.

FIG. 2 is a graph having plots that illustrate some of the signals of system 10. The abscissa indicates time and the ordinate indicates increasing value of the illustrated signal. A plot 85 illustrates a portion of a cycle of the peak value of current 16. A plot 86 illustrates current 16 during a one period of oscillator 64. Plots 87 and 88 illustrate current 16 during subsequent periods of oscillator 64. A plot 89 illustrates an average value of current 16 that is formed by controller 55 and system 10. This description has references to FIG. 1 and FIG. 2. System 10 is also configured to provide a substantially unity power factor for the input AC signal received between terminals 11 and 12. For each period (T) of oscillator 64, the waveshape of current 16 is substantially the same as the waveshape of current 16 through inductor 22 and transistor 73. Consequently, the power factor is controlled by current 16 as shown below:

The slope of input current 16 can be determined from the inductor voltage equation, $$E=L(di/dt), \text{ so}$$

$$V_{in}=(L)(di_{pk}/t_{on}).$$

Transposing for $i_{pk}$ yields $$i_{pk}=V_{in}(t_{on}/L)$$

Where;

$V_{in}$—the input voltage between terminals 11 and 12,

L—inductance of inductor 22, $i_{pk}$—the peak value of current 16, and $t_{on}$—the time that transistor 73 is enabled during a period (T) of oscillator 64.

The average value of current 16 over each period of Oscillator 64 is illustrated by plot 89 in FIG. 2. Since the waveshape of each current pulse through transistor 73 is a triangular shape, the area under the curve of each pulse of current 16 is the peak value ($i_{pk}$) times the length of time it flows during a period of oscillator 64 ($t_{on}$/T) divided by two (2) as shown by:

$$Iav=(½)((i_{pk})*(t_{on}/T)$$

Where;

Iav—the average value of current 16,

T—the period of oscillator 64, and $t_{on}$/T—the portion of each period that transistor 73 is enabled.

Substituting the equation for $i_{pk}$ back into the equation for Iav yields:

$$Iav=(½)V_{in}((t_{on})^2/(L*T))$$

The value of resistor 34 and the value of the reference voltage of regulator 41 are selected to provide a particular value for current 29. In addition, the value of the frequency compensation elements (such as capacitor 41 or capacitor 43) are chosen to keep the frequency of any oscillations of the FB signal below the frequency of the rectified AC signal between terminals 13 and 14. For an input voltage frequency of sixty Hertz (60 Hz) or fifty Hertz (50 Hz), the rectified AC signal between terminals 13 and 14 has a frequency of one hundred twenty Hertz (120 Hz) or one hundred Hertz (100 Hz), respectively. In order to ensure that controller 55 does not have adjust the duty cycle of transistor 73 in order to remove ripple components that would occur at the frequency of the rectified AC signal, the poles formed by the frequency compensation elements are chosen to ensure that the bandwidth of system 10 is less than either one hundred twenty or one hundred Hertz. In most embodiments, the elements are chosen to limit the bandwidth to no greater than about fifteen Hertz (15 Hz) and preferably to no greater than about ten Hertz (10 Hz) for a sixty Hertz (60 Hz) system or no greater than about eight Hertz (8 Hz) for a fifty Hertz system. This assists in keeping the FB signal a substantially DC signal and assists in keeping the duty cycle of transistor 73 substantially constant. Because the load formed by LEDs 25-28 is substantially constant, once the desired value of current 29 is reached controller 55 controls the value of current 29 to remain substantially constant. In order to supply the substantially constant value of current 29 to the substantially constant load with a substantially constant period of oscillator 64, controller 55 controls transistor 73 to have a substantially constant duty cycle. The value of inductor 22 is constant and since the period and duty cycle of current 16 are substantially constant, the terms ton and T in the equation for Iav are also constants and the equation for Iav becomes:

$$Iav=(\frac{1}{2})V_{in}((K1)^2/(K2))$$

where K1 and k2 are constants.

Thus,

Iav$\alpha V_{in}$, or otherwise stated, Iav is proportional to $V_{in}$.

Thus, for a fixed frequency and duty cycle, current 16 follows the input voltage $V_{in}$. Consequently, the waveshape of the average value of current 16 is substantially the same as the waveshape of $V_{in}$ which results in a power factor for system 10 that is substantially unity. A unity power factor results in a lower operating cost for system 10. For applications where a large number of LEDs are used to provide lighting for a large area, the cost saving provided by system 10 are very important. It should be noted that system 10 forms a substantially unity power factor without sensing the value or waveshape of either the input voltage or the rectified AC signal and without using multiplier circuits including multiplier circuits used to multiply the input AC voltage by the input current. Not sensing the input voltage assists in reducing the cost of controller 55 and for system 10, and no using multiplier circuits also reduces the complexity and costs.

In order to provide this functionality for system 10, an anode of LED 25 is connected to input 18 and the cathode is connected to an anode of LED 26. The cathode of LED 26 is connected to an anode and LED 27 which has a cathode connected to an anode of LED 28. The cathode of LED 28 is commonly connected to a first terminal of resistor 34, the first terminal of capacitor 44, and the sense input of regulator 41. A second terminal of capacitor 44 is connected to input 18 and alternately to the cathode of LED 26. The second terminal of resistor 34 is commonly connected to received the first common reference signal from terminal 13, and to a reference input of regulator 41. An output of regulator 41 is connected to the cathode of LED 38 which has an anode connected to a first terminal of resistor 36. The second terminal of resistor 36 is connected to the second terminal of capacitor 44. Capacitor 21 as a first terminal connected to input 18 and a second terminal connected to terminal 13. Diode 19 has an anode connected to output 56 of controller 55 and a first terminal of inductor 22. A cathode of diode 19 is connected to input 18. Second terminal of inductor 22 is connected to receive the first common reference signal from terminal 13 and to an input of converter 46. An output of converter 46 is connected to input 57. An anode of diode 47 is connected to the input of converter 46 and a cathode is connected to a first terminal resistor 48. The second terminal of resistor 48 is commonly connected to a first terminal of capacitor 49 and to the output of converter 46. The second terminal of capacitor 49 is connected to terminal 14. Transistor 39 of coupler 37 has an emitter connected to terminal 14 and a collector connected to it first terminal of capacitor 43 and input 58 of controller 55. The second terminal of capacitor 43 is connected to terminal 14. A first terminal of resistor 63 is connected to input 58 and a second terminal connected to input 57. And output of oscillator 64 is connected to a set input of latch 66 and to an input of ramp 65. And output of ramp 65 is connected to a non-inverting input of comparator 67. An inverting input of comparator 67 is connected to feedback input 58. An output of comparator 67 is connected to a first input of gate 68 a second input of gate 68 is connected to an output of comparator 71. Output of gate 68 is connected to the reset input of latch 66. A Q bar output of latch 66 is connected to a gate transistor 73. A drain of transistor 73 is connected to output 56 and source is commonly connected to input 59 and a non-inverting input of comparator 71. An inverting input of comparator 71 is connected to an output of reference 70. The first terminal of resistor 61 is connected to input 59 and a second terminal is connected to terminal 14. Return 60 of controller 55 is connected to terminal 14.

Figure 3:
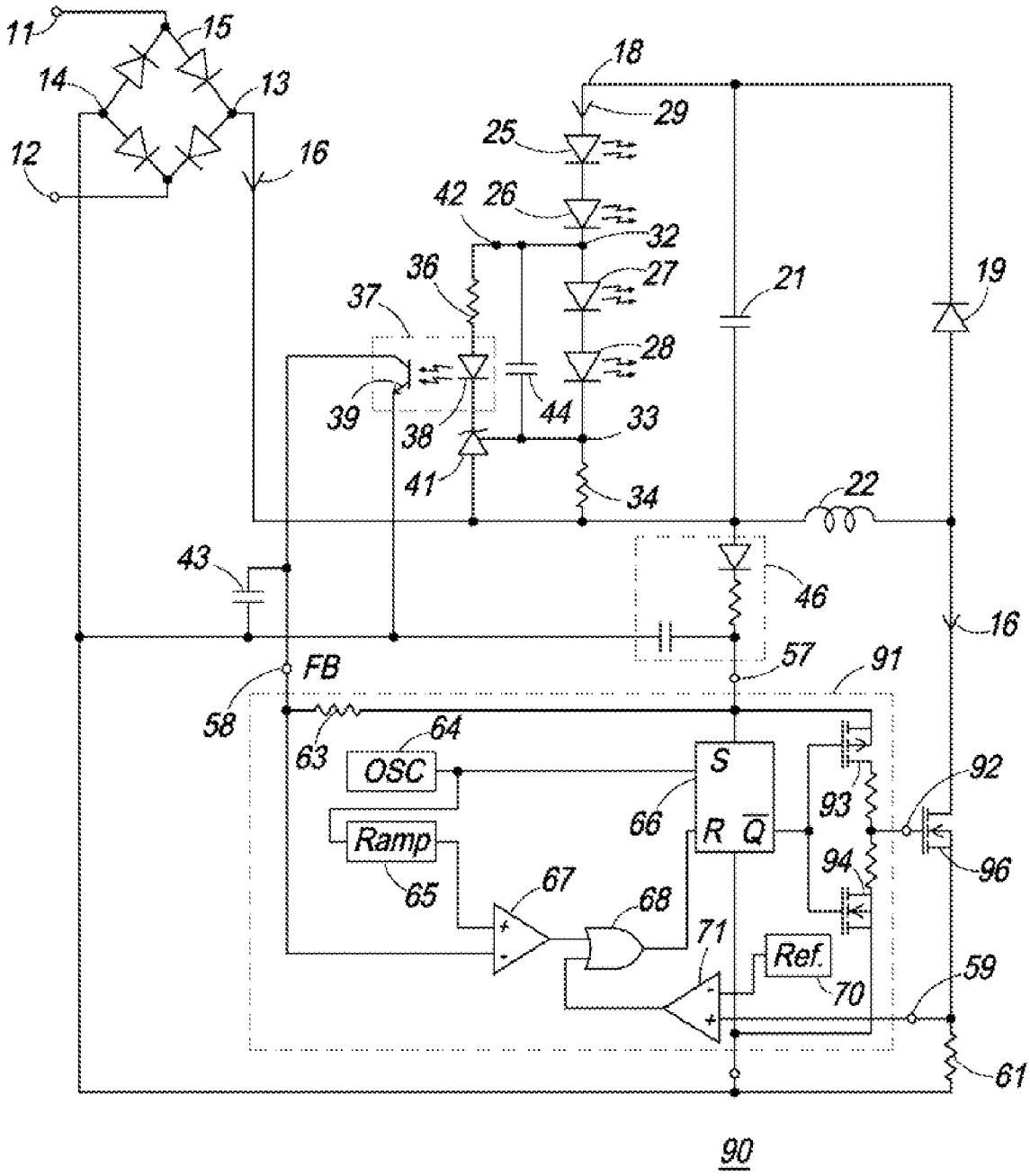
FIG. 3 schematically illustrates an embodiment of a portion of an LED system that is an alternate embodiment of the LED system of FIG. 1 in accordance with the present invention.

FIG. 3 schematically illustrates an embodiment of a portion of an LED system 90 that is an alternate embodiment of system 10 that was explained in the description of FIG. 1 and FIG. 2. System 90 is similar to system 10 except system 90 includes a PWM controller 91. Controller 91 is similar to controller 55 except controller 91 does not include a power switch such as transistor 73. Controller 91 includes a driver circuit, illustrated by transistors 93 and 94, that is configured to drive an external power switch such as a transistor 96.

Figure 4:
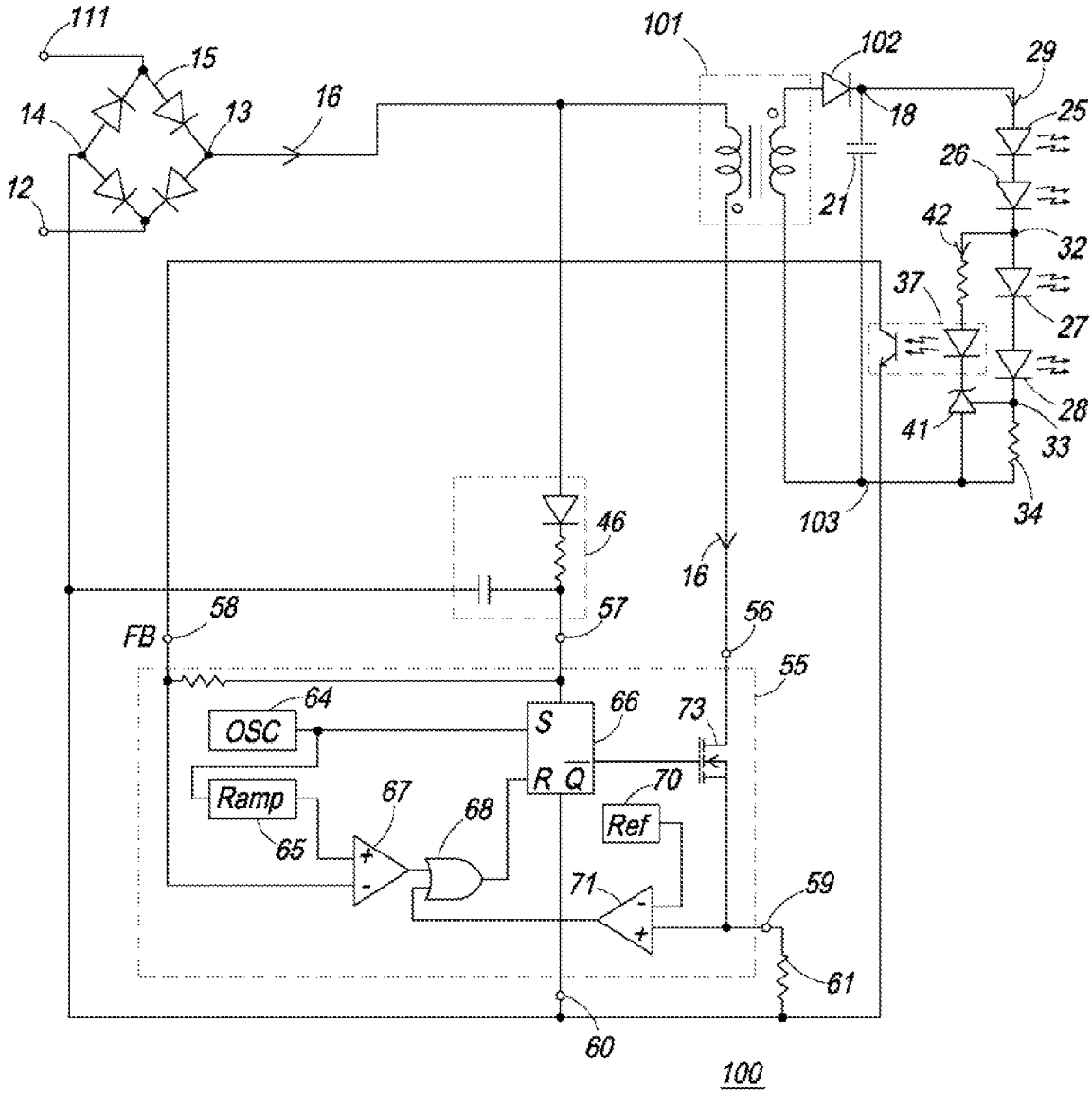
FIG. 4 schematically illustrates an embodiment of a portion of another LED system that is another alternate embodiment of the LED system of FIG. 1 in accordance with the present invention.

FIG. 4 schematically illustrates an embodiment of a portion of an LED system 100 that is an alternate embodiment of system 10 that was explained in the description of FIG. 1 and FIG. 2. System 100 is similar to system 10 except system 100 replaces inductor 22 with a transformer 101 so that system 100 is connected in a flyback configuration. System 100 includes a rectifier diode 102 that is used to rectify the signal from transformer 101 into a substantially DC voltage between LED input 18 and a common return terminal 103 that is connected to one terminal of transformer 101. The voltage on common return terminal 103 is not have a time varying signal such as the one on terminal 13 of FIG. 1, thus, the voltage between input 18 and terminal 103 does not ride on top of a time varying voltage.

Figure 5:
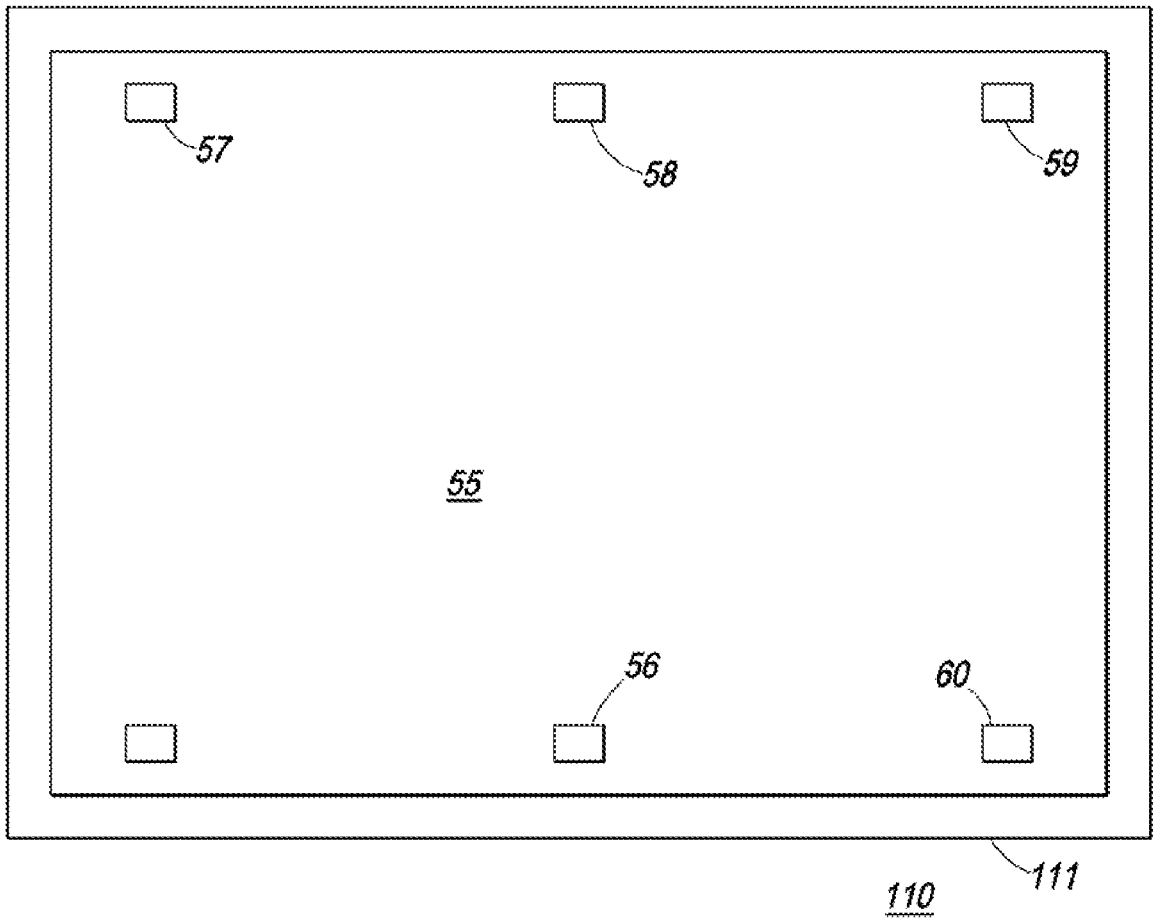
FIG. 5 schematically illustrates an enlarged plan view of a semiconductor device that includes a portion of the LED system of FIG. 1 in accordance with the present invention.

FIG. 5 schematically illustrates an enlarged plan view of a portion of an embodiment of a semiconductor device or integrated circuit 110 that is formed on a semiconductor die 111. Controller 55 is formed on die 111. Die 111 may also include other circuits that are not shown in FIG. 5 for simplicity of the drawing. Controller 55 and device or integrated circuit 110 are formed on die 111 by semiconductor manufacturing techniques that are well known to those skilled in the art. Controller 91 may alternately be formed on die 111. In one embodiment, controller 55 is formed on a semiconductor substrate as an integrated circuit having no more than six external leads 56-60 and one optional lead.

In view of all of the above, it is evident that a novel device and method is disclosed. Included, among other features, controlling a power factor of an LED system by configuring a switching power supply controller to operate at a substantially fixed frequency and a substantially fixed duty cycle. In one embodiment of a boost configuration of the LED system, the input current to the LED system is substantially equal to the current through a power switch of the LED system.

While the subject matter of the invention is described with specific preferred embodiments, it is evident that many alternatives and variations will be apparent to those skilled in the semiconductor arts. For example, controller 55 and system 10 may also be configured in other boost configurations including an inverted boost configuration. The use of the word substantially or about means that a value of element has a parameter that is expected to be very close to a stated value or position. However, as is well known in the art there are always minor variances that prevent the values or positions from being exactly as stated. It is well established in the art that variances of up to about ten percent (10%) are regarded as reasonable variances from the ideal goal of exactly as described. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. A power factor LED control system comprising:

a plurality of series coupled LEDs coupled to receive an LED current between an input and a first common return;

an error amplifier coupled to form an error signal that is representative of the LED current; and a PWM controller coupled to receive a signal that is representative of the LED current and control the LED current to a substantially constant value wherein the PWM controller is coupled between the first common return and a second common return to receive an operating voltage for the PWM controller wherein the PWM controller does not sense a waveshape of an AC input voltage received by the power factor LED control system.

2. The LED control system of claim 1 wherein the first common return has a time varying signal.

3. The LED control system of claim 1 wherein the second common return has a substantially fixed signal.

4. The LED control system of claim 1 further including a power switch coupled to be controlled by the PWM controller, and an inductor coupled between the first common return and the power switch.

5. The LED control system of claim 1 wherein the PWM controller is devoid of a multiplier circuit.

6. The LED control system of claim 1 wherein the plurality of series coupled LEDs includes a first LED having a cathode and having an anode coupled to the input, a second LED having a cathode coupled to the first common return and having an anode.

7. The LED control system of claim 6 wherein the error amplifier has a sense input coupled to the cathode of the second LED and a reference input coupled to the first common return.

8. The LED control system of claim 6 further including an inductor having a first terminal coupled to the first common return and having a second terminal.

9. The LED control system of claim 8 wherein the second terminal of the inductor is coupled to a power switch that is controlled by the PWM controller and is also coupled to a rectifier wherein the rectifier is coupled to the anode of the first LED.

10. A power factor LED control system comprising:

a plurality of series coupled LEDs referenced to a first common reference signal;

an error amplifier coupled to provide an error signal that is representative of a current through the plurality of series coupled LEDs wherein the error amplifier is referenced to the first common reference signal; and a PWM controller operably coupled to receive a signal that is representative of the current through the plurality of series coupled LEDs and form a substantially dc voltage for operating the plurality of series coupled LEDs wherein the PWM controller is configured to operate at a substantially fixed frequency and a substantially constant duty cycle and wherein the PWM controller is referenced to a second common reference signal.

11. The power factor LED control system of claim 10 wherein the error amplifier has a sense input coupled to one of the plurality of series coupled LEDs.

12. The power factor LED control system of claim 10 further including a transformer having a primary side coupled to be controlled by the PWM controller and a secondary side coupled to the plurality of series coupled LEDs wherein the plurality of series coupled LEDs are coupled in parallel with the secondary side of the transformer.

13. The power factor LED control system of claim 10 wherein the plurality of series coupled LEDs is reference to a time varying signal.

14. The power factor LED control system of claim 13 wherein the error amplifier is referenced to the time varying signal.

15. The power factor LED control system of claim 14 further including an inductor having a first terminal coupled to the first common reference signal and a second terminal coupled to be controlled by the PWM controller.

* * * * *